US007191695B2

(12) United States Patent
Sato et al.

(10) Patent No.: US 7,191,695 B2
(45) Date of Patent: Mar. 20, 2007

(54) LINEAR ACTUATOR

(75) Inventors: Toshio Sato, Tsukuba (JP); Akira Tadano, Tsuchiura (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/108,705

(22) Filed: Apr. 19, 2005

(65) Prior Publication Data

US 2005/0235824 A1 Oct. 27, 2005

(30) Foreign Application Priority Data

Apr. 26, 2004 (JP) ..... 2004-130246

(51) Int. Cl.
*F15B 15/24* (2006.01)
*F15B 15/26* (2006.01)

(52) U.S. Cl. ..... 92/13.7; 92/20; 92/88

(58) Field of Classification Search ..... 92/13.7, 92/20, 88, 128, 163, 169.1
See application file for complete search history.

(56) References Cited

U.S. PATENT DOCUMENTS 5,884,549 A * 3/1999 Hosono et al. ..... 92/88
6,196,110 B1 * 3/2001 Angue ..... 92/88

FOREIGN PATENT DOCUMENTS

JP 2540597 7/1997

* cited by examiner

*Primary Examiner*—Michael Leslie
(74) *Attorney, Agent, or Firm*—Paul A. Guss

(57) ABSTRACT

A displacement amount-adjusting mechanism for adjusting the displacement amount of a slide table includes a stopper which faces a cutout formed at a bottom surface of the slide table and which is fixed to an upper surface of a main cylinder body, a first adjuster bolt which is provided movably back and forth on the slide table and which is screwed into a screw hole communicating with the cutout, an adjuster plate which is fixed to an end surface of the main cylinder body, and a second adjuster bolt which is screwed into a hole of the adjuster plate.

9 Claims, 8 Drawing Sheets

20
68
72
80d
80b
24
81a
84d
80c
80b
29
84c
80a
81b
74
84a
84b
86b
34
88
91
92
90
86a
94
59a (c)
58
56
59b (d)
48
44
46
42
50
70
61
36
82d
26
50a
28
32b
82b
27
108a (b)
82c
30
66a (b)
22
37
82a
64a (b)
40
32a
52
54
96
100
93
A
B
98
102
95b
95a

LINEAR ACTUATOR

BACKGROUND OF THE INVENTION

1. Field of the Invention

The present invention relates to a linear actuator which allows a slider to reciprocate in the axial direction of a main cylinder body by introducing a pressure fluid from fluid inlet/outlet ports.

2. Description of the Related Art

A linear actuator has been hitherto used as a means for transporting a workpiece or the like. Such a linear actuator transports the workpiece placed on a slide table by allowing the slide table to reciprocate linearly along a main cylinder body.

The linear actuator concerning the conventional technique (see, for example, Japanese Utility Model Registration No. 2540597) comprises a main cylinder body which includes a piston movably therein, a rod which is connected to the piston and which protrudes from the side of the main cylinder body to the outside, a table which has a vertically extending section connected to one end of the rod and which is provided displaceably in the axial direction of the main cylinder body, and a linear guide which has a guide block for sliding along a guide rail formed to expand on the upper surface of the main cylinder body.

The linear actuator is operated as follows. When air is supplied to a forward movement port provided on the side of the main cylinder body, then the piston is moved, and the table, which is attached to the upper surface of the main cylinder body, is also moved together. The table is smoothly guided by the linear guide provided between the table and the main cylinder body, and thus the table can reciprocate linearly.

However, in the case of this linear actuator, the following structure is adopted. That is, a stopper is connected to the other end of the rod which is disposed on the side opposite to the table (vertically extending section) and which protrudes from the main cylinder body to the outside. The stopper makes abutment against the end surface of the main cylinder body, and thus the forward movement end of the table is regulated. Therefore, the rod, which has the stopper, protrudes to the outside of the main cylinder body by the stroke length in which the table is moved. Therefore it is not possible to make the entire liner actuator compact in size. Further, this linear actuator does not have with any means for regulating the backward movement end of the table. It is not possible to arbitrarily adjust the stroke amount of the backward movement of the table. Therefore, it is not possible to make the entire apparatus small in size, and ensure the convenience of the apparatus.

SUMMARY OF THE INVENTION

A general object of the present invention is to provide a linear actuator which makes it possible to make the entire apparatus small in size and improve the convenience of the apparatus.

A main object of the present invention is to provide a liner actuator which can be preferably used in an environment such as a clean room in which cleanness is required.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
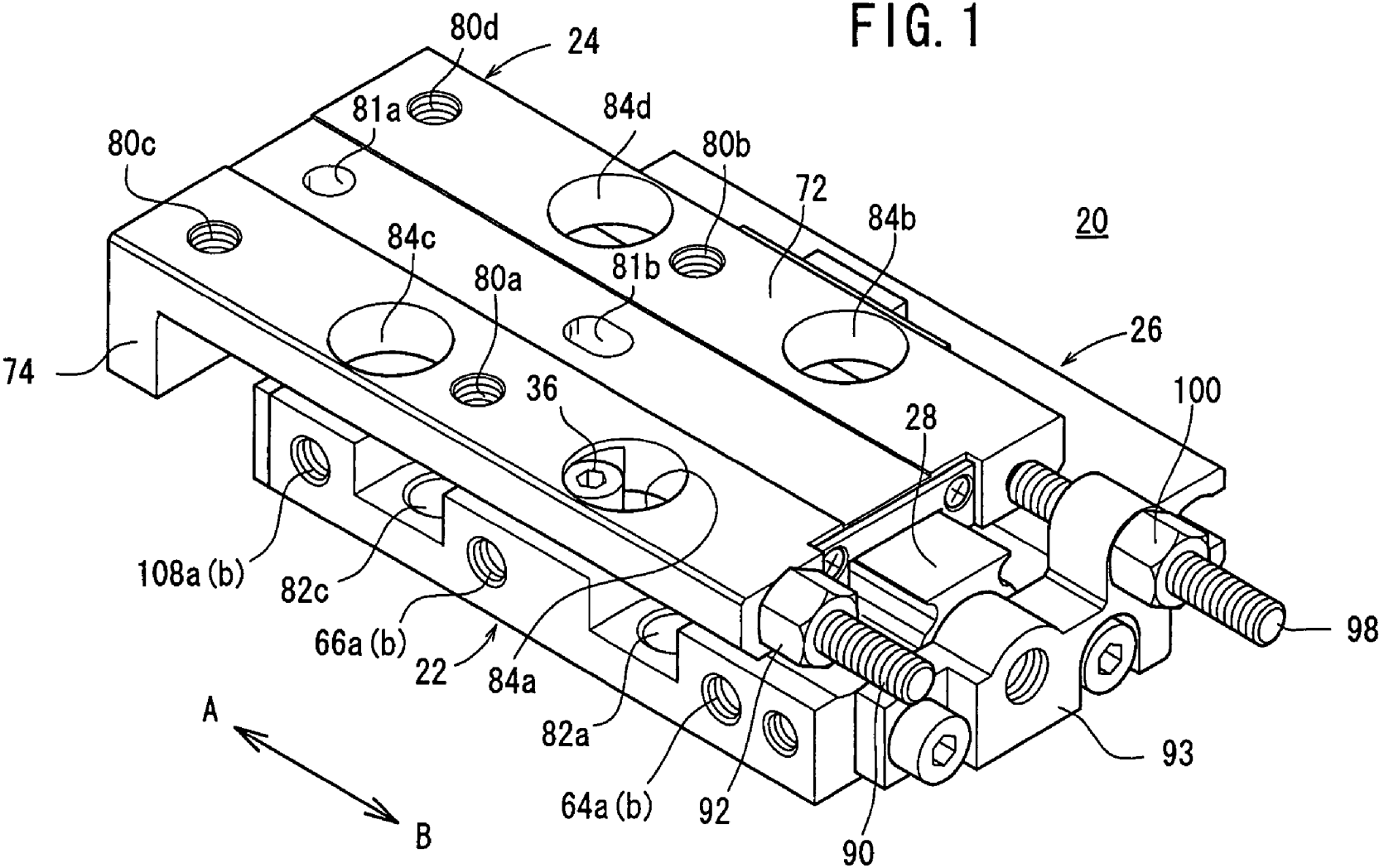
FIG. 1 is a perspective view illustrating a linear actuator according to a first embodiment of the present invention.

With reference to FIG. 1, reference numeral 20 indicates a linear actuator according to a first embodiment of the present invention. The linear actuator 20 includes a main cylinder body 22 which is of a substantially rectangular parallelepiped shape, a slide table (slider) 24 which reciprocates linearly in the longitudinal direction of the main cylinder body 22, and a sensor attachment rail 26 which is screwed to one side surface of the main cylinder body 22.

Figure 2:
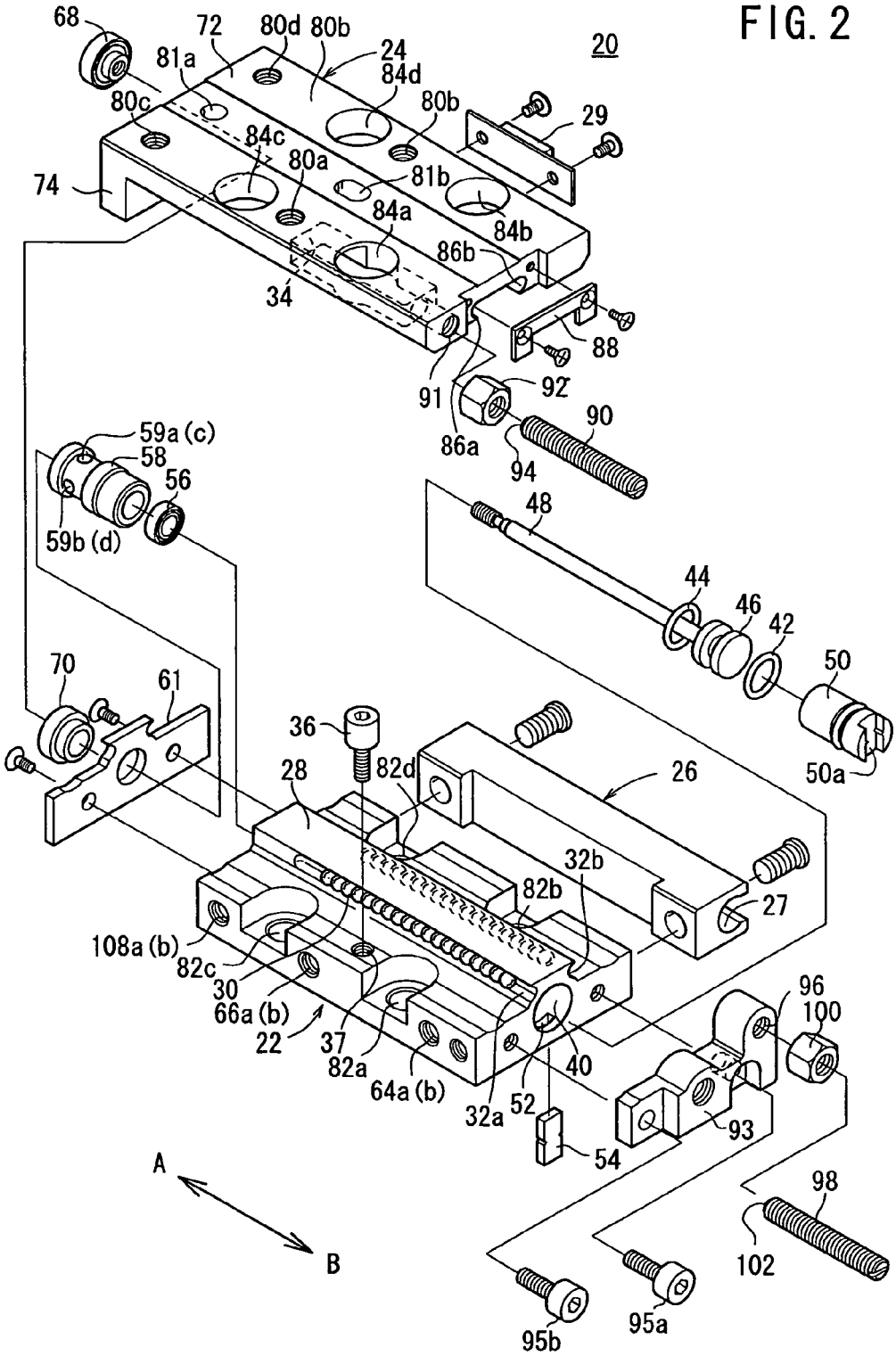
FIG. 2 is an exploded perspective view illustrating the linear actuator shown in FIG. 1.
Figure 3:
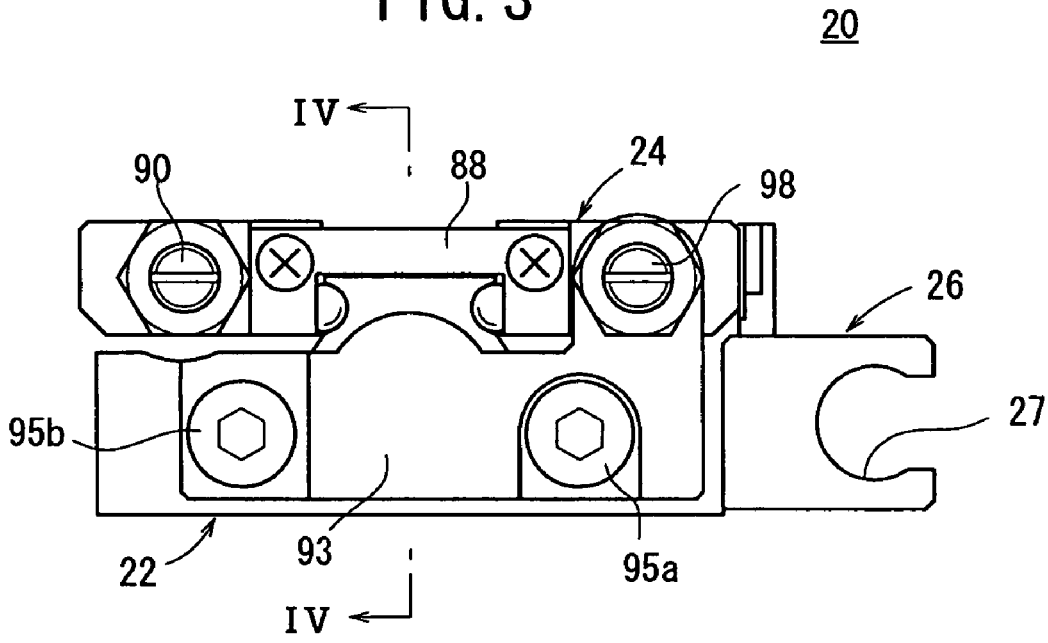
FIG. 3 is a side view illustrating the linear actuator shown in FIG. 1 as viewed in the axial direction.

As shown in FIGS. 1 and 2, a guide section 28, which extends in the axial direction of the main cylinder body 22, is formed to expand integrally with the main cylinder body 22 at an upper surface portion of the main cylinder body 22. Ball-rolling grooves 32*a*, 32*b*, each of which has a circular arc-shaped cross section for allowing a plurality of ball bearings 30 to roll, are formed in the longitudinal direction on opposing side surfaces of the guide section 28.

As shown in FIG. 2, a rectangular cutout 34 is formed on the lower surface of the slide table 24 which faces the upper surface of the main cylinder body 22. A stopper 36, which is fixed on the upper surface of the main cylinder body 22, faces the interior of the cutout 34. In this arrangement, the stopper 36 is composed of a screw member having a columnar portion. The stopper 36 is screwed into a screw hole 37, which is formed at a substantially central portion of the upper surface of the main cylinder body 22, and fixed to the main cylinder body 22.

As shown in FIG. 2, a through-hole 40 is formed in the axial direction in the main cylinder body 22. A piston 46 which is installed with a piston packing 42 and a damper 44 on its outer circumferential surface, and a piston rod 48 which is connected to the piston 46 are accommodated in the through-hole 40.

One end of the through-hole 40 is closed by an end cap 50 in an air-tight manner. The end cap 50 is prevented from being disengaged such that a fastening piece 54, which is inserted along a hole 52 from the bottom surface side of the main cylinder body 22, is engaged with a fastening groove 50*a* which is formed on the end surface of the end cap 50 (see FIGS. 2 and 4). The end cap 50 is fastened by the fastening piece 54 so that one end of the through-hole 40 is closed. Accordingly, the assembling operation is convenient, and the assembling can be performed with ease. The other end of the through-hole 40 is closed by a rod packing 56 and a rod cover 58 which slides with respect to the outer circumferential surface of the piston rod 48 and which are retained in the through-hole 40.

The rod cover 58 is composed of a substantially cylindrical member formed of a resin material. The rod cover 58 is prevented from being disengaged by a plate 61 which is installed by screws to the end surface of the main cylinder body 22. The rod cover 58 functions as a bearing for the piston rod 48. The rod cover 58 is provided with a plurality of holes 59*a* to 59*d* which are formed and spaced at angles of 90 degrees in the circumferential direction in order to suck dust or the like generated at the bearing portion of the piston rod 48 and the sliding portion with respect to the rod packing 56 when the vacuum suction is effected via a vacuum port 108*a* (108*b*) as described later on.

Figure 4:
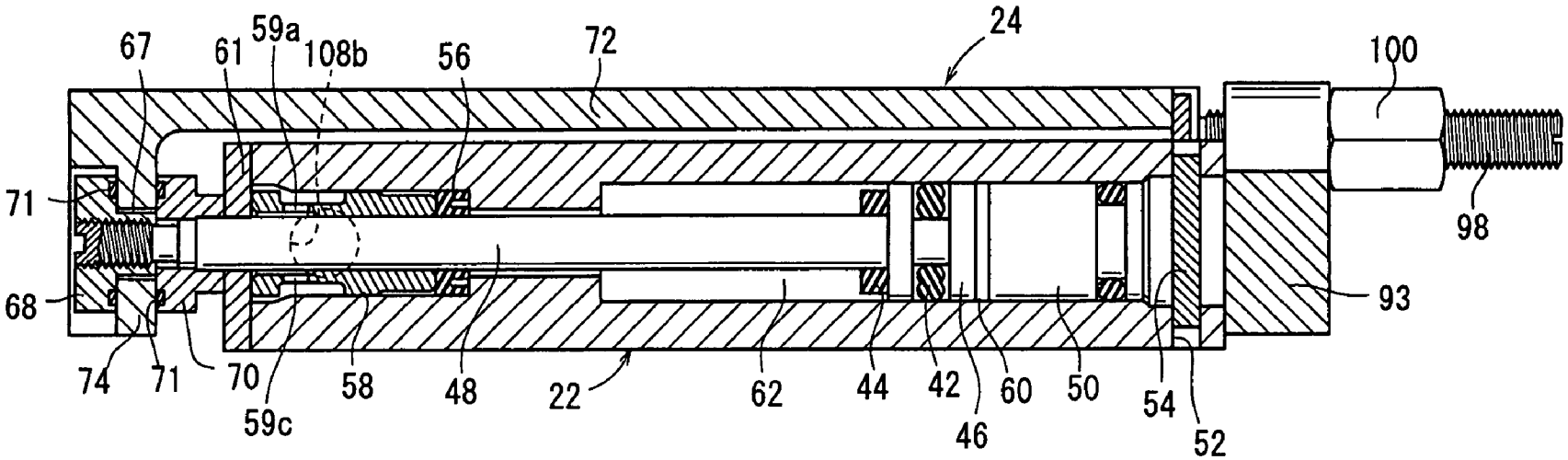
FIG. 4 is a longitudinal sectional view taken along a line IV—IV shown in FIG. 3.

In this arrangement, a first cylinder chamber 60 and a second cylinder chamber 62 are substantially formed by the end cap 50 and the rod cover 58 which close both ends of the through-hole 40 (see FIG. 4).

A pair of first fluid inlet/outlet ports 64*a*, 64*b* and a pair of second fluid inlet/outlet ports 66*a*, 66*b* are arranged at axisymmetric positions on opposing side surfaces of the main cylinder body 22, the axis of the main cylinder body 22 being the axis of symmetry. The first fluid inlet/outlet ports 64*a*, 64*b* communicate with the first cylinder chamber 60, and the second fluid inlet/outlet ports 66*a*, 66*b* communicate with the second cylinder chamber 62.

A floating mechanism, which absorbs positional deflection between the slide table 24 and the piston rod 48, is provided at the forward end of the piston rod 48. As shown in FIGS. 2 and 4, the floating mechanism comprises a first bush 68 and a second bush 70 which sandwich the slide table 24 with a clearance 67 intervening therebetween.

As shown in FIG. 2, the slide table 24 has a substantially L-shaped cross section composed of a tabular table section 72 and a bent section 74. The slide table 24 is integrally formed by metal injection molding, or casting. An unillustrated buffer member is inserted into a hole formed for the bent section 74. The buffer member functions to mitigate shocks which are generated when the bent section 74 abuts against the end surface of the main cylinder body 22 at one displacement terminal end position of the slide table 24.

O-rings (seal rings) 71 are fitted to annular grooves on the contact surfaces of the first and second bushes 68, 70 which sandwich the bent section 74 of the slide table 24 (see FIG. 4). The O-rings 71 function to avoid dust, which is generated when the first and second bushes 68, 70 float, from escaping to the outside. The clearance 67 is formed with respect to the bent section 74 in order to secure the floating of the first and second bushes 68, 70. Since the O-rings 71 elastically deform to fill the clearance 67, it is possible to avoid backlash or loosening from occurring.

The table section 72 is formed with four workpiece-retaining holes 80*a* to 80*d*, positioning holes 81*a*, 81*b* including a circular hole and a long hole, four through-holes 84*a* to 84*d* which penetrate through the table section 72 and correspond to attachment holes 82*a* to 82*d* of the main cylinder body 22 (see FIG. 2). In this arrangement, unillustrated attachment bolts can be screwed into the attachment holes 82*a* to 82*d* from the upper surface side of the table section 72 through the through-holes 84*a* to 84*d* to attach the main cylinder body 22 to another member. Alternatively, the main cylinder body 22 can be attached by directly screwing bolts into the attachment holes 82*a* to 82*d* from the bottom surface side of the main cylinder body 22. In this manner, the operator can select from the upward direction or the downward direction for the attaching the linear actuator 20.

The through-hole 84*a* is provided to communicate with the cutout 34. Therefore, the slide table 24 is arbitrarily moved so that the position of the through-hole 84*a* is substantially coincident with the position of the screw hole 37, and the stopper 36 is screwed into the screw hole 37 at the upper surface of the main cylinder body 22 through the through-hole 84*a*. Thus, the stopper 36 is fixed to the main cylinder body 22.

As shown in FIG. 2, a recess, which corresponds to the guide section 28 extending in the longitudinal direction over the upper surface of the main cylinder body 22, is formed at the lower surface of the slide table 24. A pair of ball-rolling grooves 86*a*, 86*b*, which are opposed to one another, are formed on the recess in the longitudinal direction.

As shown in FIG. 2, a screw hole 91, into which a first adjuster bolt 90 to function as a displacement amount-adjusting mechanism, is formed at one end surface of the slide table 24. The screw hole 91 is provided to communicate with the cutout 34. A buffer member 94, which is composed of, for example, a rubber material such as urethane, is installed to the forward end of the first adjuster bolt 90. The first adjuster bolt 90 is fixed at a desired position by a lock nut 92. A plate 88 is installed to one end surface of the slide table 24 so that the ball bearings 30, which effect the rolling movement along the ball-rolling grooves 32*a*, 32*b*, 86*a*, 86*b*, are prevented from disengaging.

In this embodiment, the stopper 36, which faces the cutout 34 between the main cylinder body 22 and the slide table 24, is fixed to the main cylinder body 22, and the first adjuster bolt 90 is provided movably back and forth for the slide table 24. However, there is no limitation to the arrangement. For example, the following arrangement is also available. That is, the stopper 36, which faces the cutout 34 formed for the main cylinder body 22, is fixed to the slide table 24, and the main cylinder body 22 is provided with the first adjuster bolt 90 which is provided movably back and forth.

A substantially L-shaped adjuster plate (attachment member) 93 is fixed by bolts 95*a*, 95*b* to one end surface of the main cylinder body 22. A second adjuster bolt 98, which functions as a displacement amount-adjusting mechanism of the slide table 24, is screwed into a hole 96 of the adjuster plate 93 by a lock nut 100. The forward end of the second adjuster bolt 98 abuts against the end surface of the slide table 24. A buffer member 102, which is composed of, for example, a rubber material such as urethane, is also installed to the forward end of the second adjuster bolt 98.

When the slide table 24 moves forward (in the direction of the arrow A shown in FIG. 1), then the first adjuster bolt 90 is displaced integrally with the slide table 24, and the buffer member 94 abuts against the stopper 36 fixed to the upper surface of the main cylinder body 22. Accordingly, the movement of the slide table 24 in the direction of the arrow A is regulated.

On the other hand, when the slide table 24 moves backward (in the direction of the arrow B shown in FIG. 1), then the slide table 24 is displaced, and the end surface of the slide table 24 abuts against the second adjuster bolt 98 fixed at the end surface of the main cylinder body 22 by the adjuster plate 93. Accordingly, the movement of the slide table 24 in the direction of the arrow B is regulated.

In other words, the stroke is regulated at the forward movement end of the slide table 24 with respect to the main cylinder body 22 by the first adjuster bolt 90 which makes abutment against the stopper 36. The stroke is also regulated at the backward movement end of the slide table 24 with respect to the main cylinder body 22 by the end surface of the slide table 24 which makes abutment against the second adjuster bolt 98 retained by the adjuster plate 93.

The buffer members 94, 102 are provided at the forward ends of the first and second adjuster bolts 90, 98 respectively. Accordingly, it is possible to suppress unbalanced load which is applied to the slide table 24 when the slide table 24 arrives at each of the displacement terminal end positions. As a result, it is possible to avoid the transmission of the unbalanced load to the unillustrated workpiece to be placed on the slide table 24.

The guide mechanism, which guides the slide table 24 in the axial direction of the main cylinder body 22, includes the guide section 28 which is formed integrally to expand at the upper surface portion of the main cylinder body 22 and which has the pair of opposing ball-rolling grooves 32*a*, 32*b* formed on both side surfaces thereof, and the pair of ball-rolling grooves 86*a*, 86*b* which are formed on both side surfaces of the recess provided at the central portion in the longitudinal direction of the lower surface of the slide table 24.

As shown in FIG. 2, the sensor attachment rail 26 is detachably provided by a pair of screw members on one side surface of the main cylinder body 22. The sensor attachment rail 26 has a single long hole 27 having a circular arc-shaped cross section formed in the axial direction. An unillustrated sensor is selectively fastened to a predetermined portion of the long hole 27.

Figure 5:
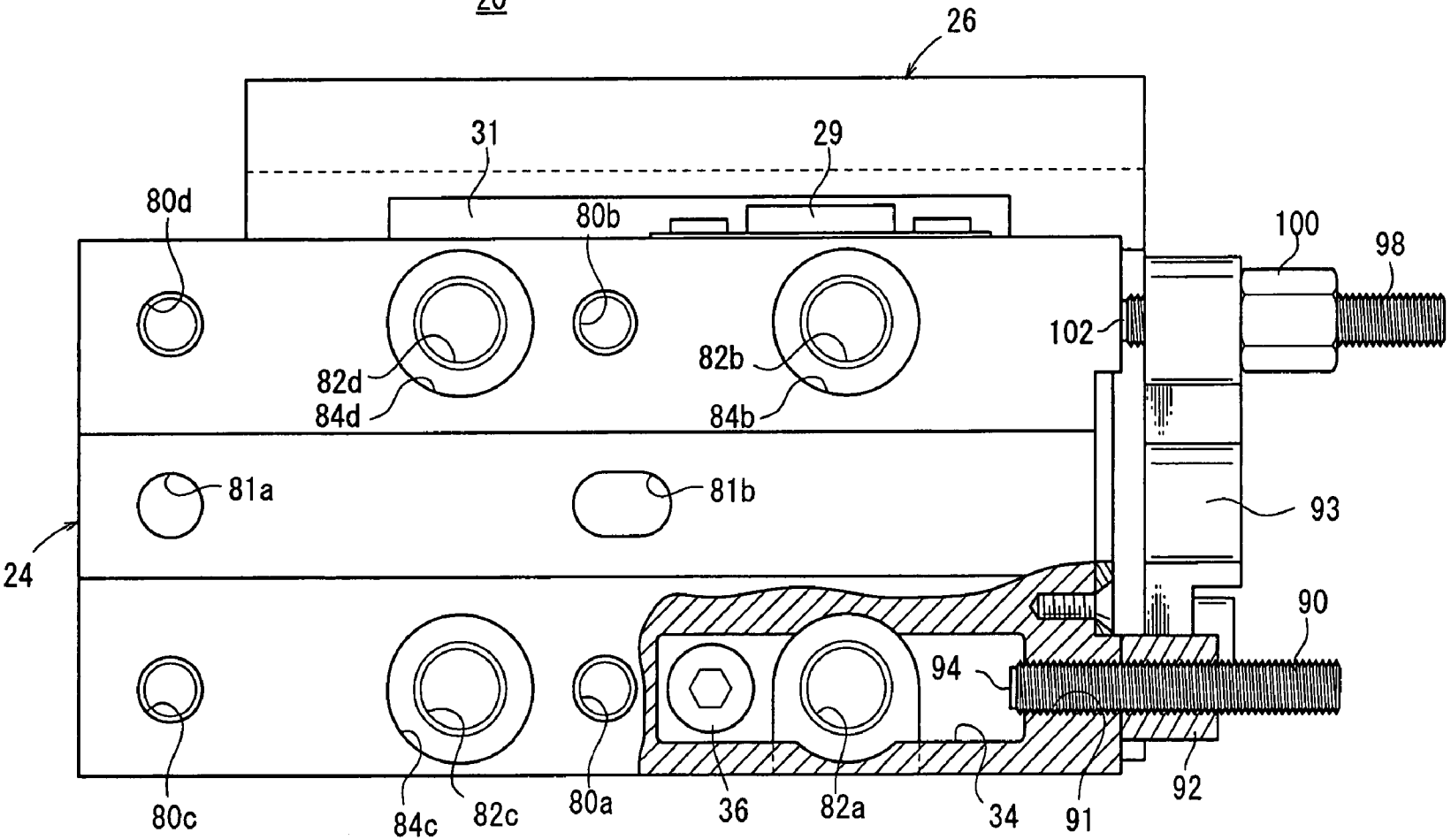
FIG. 5 is, with partial cutaway, a plan view illustrating the linear actuator shown in FIG. 1.
Figure 6:
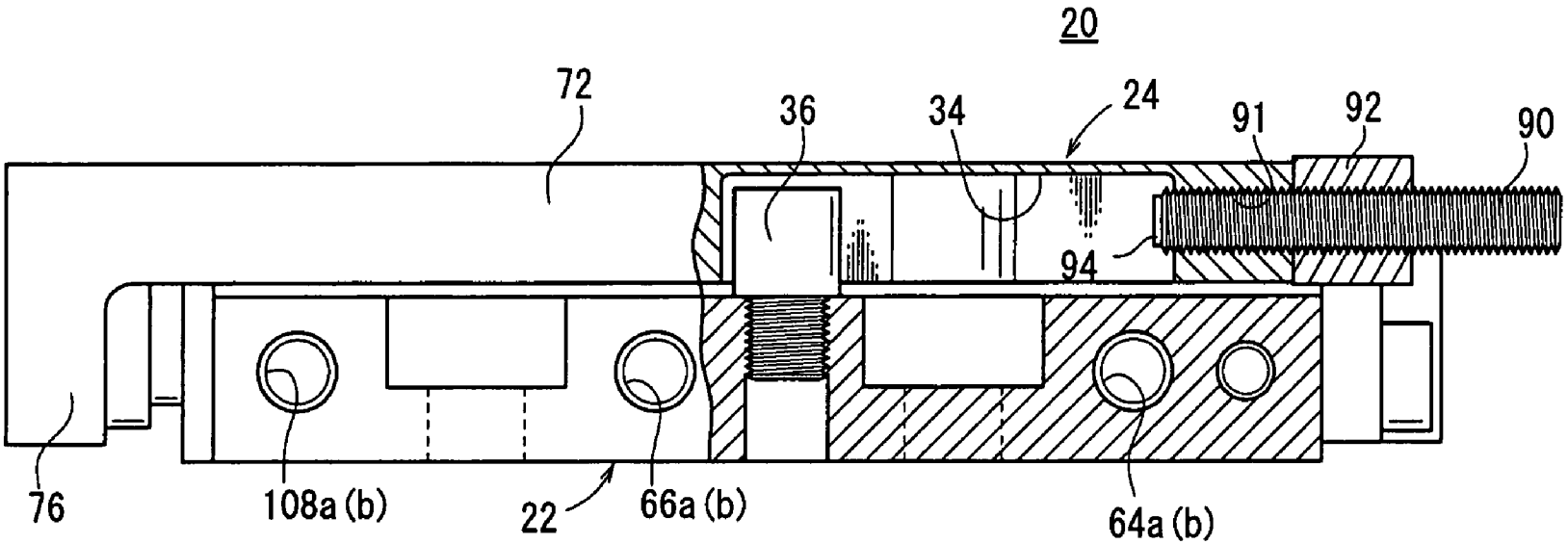
FIG. 6 is, with partial cutaway, a side view illustrating the linear actuator shown in FIG. 1.

As shown in FIG. 5, a gap 31 is formed between the side surface of the sensor attachment rail 26 and the side surface of the main cylinder body 22, the side surfaces being opposed to one another. The gap 31 separates the side surfaces at a predetermined spacing distance except at both ends serving as connecting portions. A magnetic member 29 is fixed by an attachment fixture to a predetermined portion of the side surface of the slide table 24. The magnetic member 29 is provided to make displacement along the gap 31.

Therefore, the magnetic field of the magnetic member 29 which is displaceable integrally with the slide table 24 is detected by an unillustrated sensor installed to the sensor attachment rail 26. Accordingly, the position of movement of the slide table 24 is detected.

Vacuum ports (suction ports) 108*a*, 108*b* are provided at the side surfaces of the main cylinder body 22 respectively. An unillustrated suction means such as a vacuum pump is connected to the vacuum port 108*a* (108*b*) to perform the vacuum suction through the holes 59*a* to 59*d* formed for the rod cover 58 in order to suck air escaping from the second cylinder chamber 62 and dust generated by the sliding movement effected between the piston rod 48 and the rod packing 56. Accordingly, it is possible to preferably use the linear actuator 20, for example, in an environment such as a clean room in which cleanness is required.

The linear actuator 20 according to the first embodiment of the present invention is basically constructed as described above. Next, its operation, function, and effect will be explained.

An unillustrated fluid pressure supply source is energized to supply the pressure fluid to the first fluid inlet/outlet port 64*a*. In this situation, the second fluid inlet/outlet port 66*a* is open to the atmospheric air by operating an unillustrated changeover valve.

The pressure fluid is supplied to the first cylinder chamber 60 which communicates with the first fluid inlet/outlet port 64*a*, and the pressure fluid presses the piston 46 in the direction of the arrow A shown in FIG. 1. The slide table 24, which is engaged with the piston rod 48, is displaced in the direction of the arrow A shown in FIG. 1 under the pressing action of the piston 46. The slide table 24 is displaced under the rolling action of the ball bearings 30.

The first adjuster bolt 90, which is displaced integrally with the slide table 24, abuts against the stopper 36 fixed to the upper surface of the main cylinder body 22 during the process in which the slide table 24 is displaced in the direction of the arrow A shown in FIG. 1 (forward movement). Accordingly, the slide table 24 arrives at one displacement terminal end position. In this embodiment, when the lock nut 92 is loosened to adjust the screwing amount of the first adjuster bolt 90, then the displacement amount of the slide table 24 is increased or decreased, and thus it is possible to adjust the position of the forward movement end of the slide table 24.

When the slide table 24 is displaced in the direction of the arrow B (backward movement) reversely to the above, the pressure fluid is supplied to the second fluid inlet/outlet port 66*a*. The supplied pressure fluid is introduced into the second cylinder chamber 62, and the pressure fluid presses the piston 46 in the direction of the arrow B shown in FIG. 1. The slide table 24, which is engaged with the piston rod 48, is displaced in the direction of the arrow B under the pressing action of the piston 46. The end surface of the slide table 24 abuts against the second adjuster bolt 98 fixed at the end surface of the main cylinder body 22 by the adjuster plate 93. Accordingly, the slide table 24 arrives at the other displacement terminal end position.

When the screwing amount of the second adjuster bolt 98 with respect to the hole 96 of the adjuster plate 93 is adjusted, then the displacement amount of the slide table 24 is increased or decreased, and thus it is possible to adjust the position corresponding to the backward movement end of the slide table 24. The buffer members 94, 102, which absorb shocks upon the abutment against the slide table 24, are provided at the forward ends of the first adjuster bolt 90 and the second adjuster bolt 98. Thus, it is also possible to suppress unbalanced load.

As a result, the linear actuator 20 according to the first embodiment makes it possible to make the entire apparatus small in size and light in weight. It is also possible to improve the convenience of the apparatus.

Figure 7:
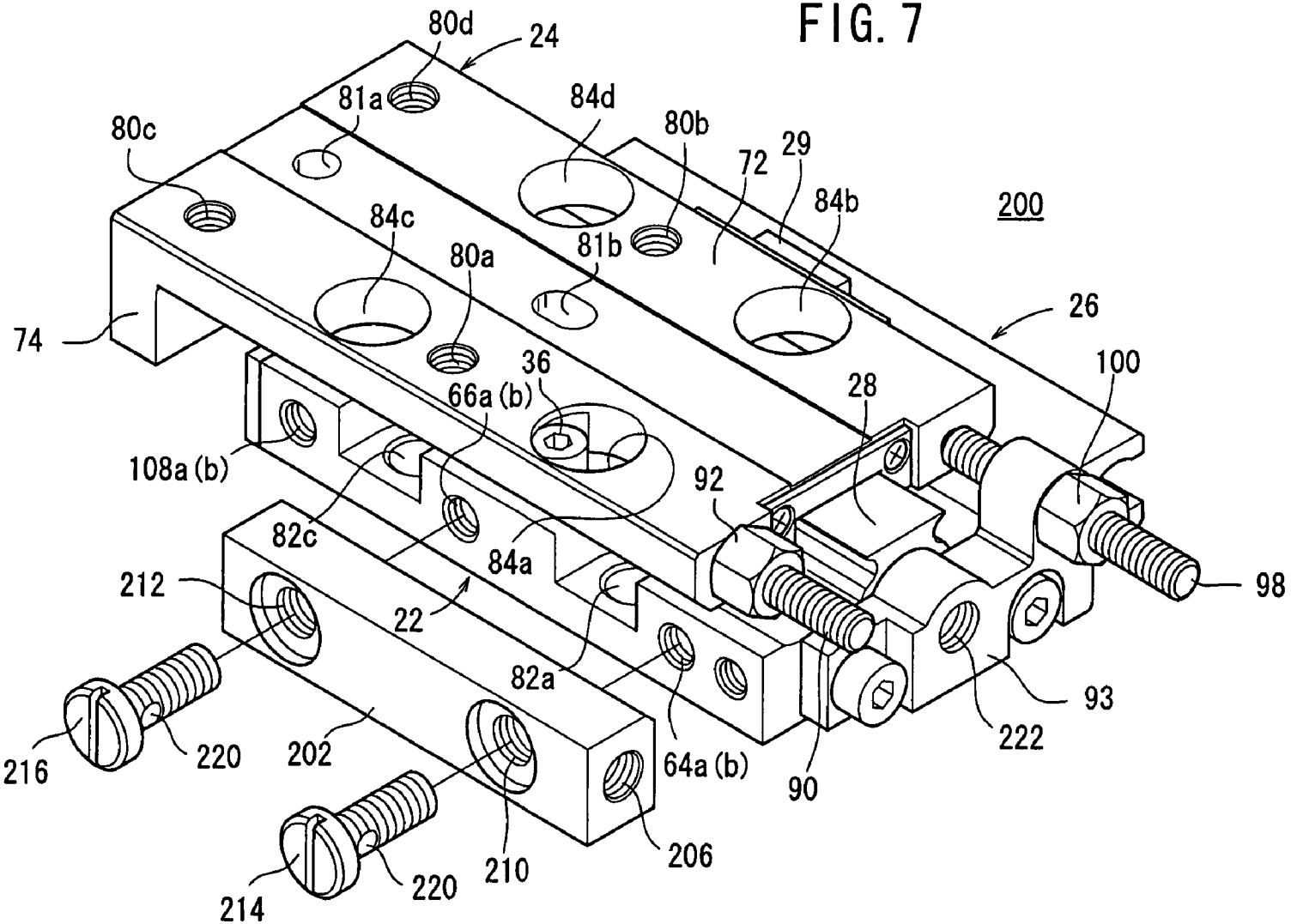
FIG. 7 is a perspective view illustrating a linear actuator according to a second embodiment of the present invention.
Figure 8:
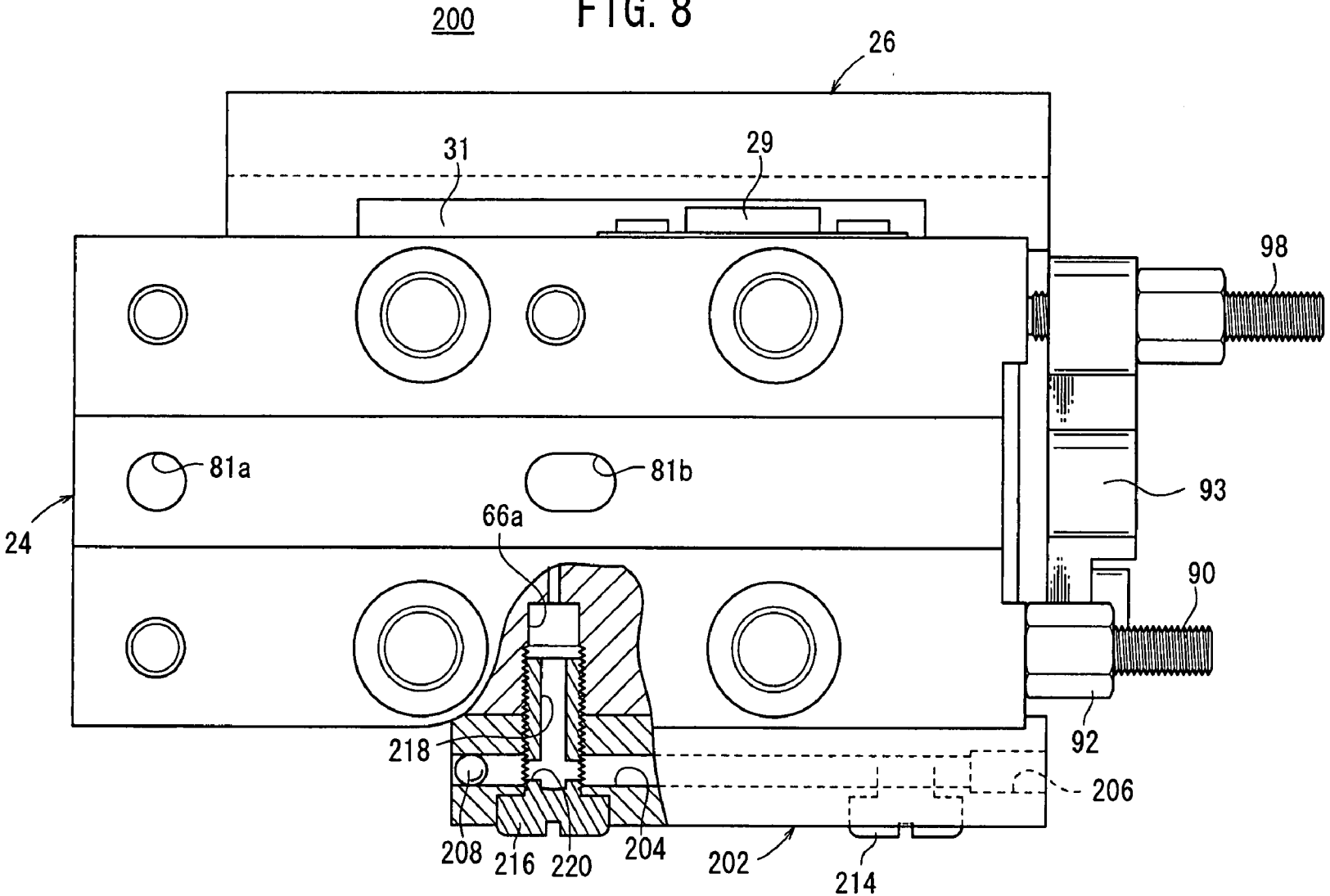
FIG. 8 is, with partial cutaway, a plan view illustrating the linear actuator shown in FIG. 7.

Next, a linear actuator 200 according to a second embodiment of the present invention is shown in FIGS. 7 and 8. The same constitutive components as those of the linear actuator 20 according to the first embodiment are designated by the same reference numerals, any detailed explanation of which will be omitted.

The linear actuator 200 according to the second embodiment differs in that a piping block 202, which is formed separately, is connected to the main cylinder body 22 on the side surface opposing the side surface to which the sensor attachment rail 26 is connected. A penetrating passage 204 is provided through the piping block 202 in the longitudinal direction. A third fluid inlet/outlet port 206 is provided at one end of the penetrating passage 204, and the other end is closed by forcibly inserting a steel ball 208 (see FIG. 8).

A pair of screw holes 210, 212 are formed in the piping block 202 penetrating therethrough in the direction perpendicular to the penetrating passage 204. Piping screws (piping members) 214, 216, which are constructed identically, are screwed into the first fluid inlet/outlet port 64*a* and the second fluid inlet/outlet port 66*a* respectively through the screw holes 210, 212 of the piping block 202. Thus, the piping block 202 is fixed to the main cylinder body 22.

In this arrangement, as shown in FIG. 8, a fluid passage 218, which extends in the axial direction, is provided in the piping screw 216. The piping screw 216 is provided with a communication passage 220 extending in the direction perpendicular to the fluid passage 218 to communicate with the second fluid inlet/outlet port 66*a* and the third fluid inlet/outlet port 206. An unillustrated blank cap (for example, a steel ball) is installed between the piping screw 214 and the first fluid inlet/outlet port 64*a* to close the first fluid inlet/outlet port 64*a*.

As shown in FIG. 7, a fourth fluid inlet/outlet port 222, which communicates with the first cylinder chamber 60, is provided at a substantially central portion of the adjuster plate 93 fixed to the end surface of the main cylinder body 22. In this arrangement, an unillustrated communication passage, which communicates with the fourth fluid inlet/outlet port 222 and the first cylinder chamber 60, is formed through the end cap 50 installed to one end of the through-hole 40 of the main cylinder body 22.

The linear actuator 200 according to the second embodiment is more convenient in that the third fluid inlet/outlet port 206 and the fourth fluid inlet/outlet port 222 are provided on the end surface side of the main cylinder body 22 respectively, and it is possible to connect the pipings and extract the pipings from only the axial direction of the main cylinder body 22.

Other functions and effects of the linear actuator 200 according to the second embodiment are the same as those of the linear actuator 20 according to the first embodiment except that the degree of freedom of installation is improved by adding the piping block 202. Therefore, any detailed explanation thereof is omitted.

As described above, according to the linear actuators 20, 200 of the first and second embodiments, it is possible to make the entire apparatus small in size, and it is possible to improve the convenience of the apparatus.

Although certain preferred embodiments of the present invention have been shown and described in detail, it should be understood that various changes and modifications may be made therein without departing from the scope of the appended claims.

What is claimed is:

1. A linear actuator comprising:

a main cylinder body which is formed with cylinder chambers communicating with fluid inlet/outlet ports;

a slider which reciprocates in an axial direction of said main cylinder body;

a cylinder mechanism which allows said slider to reciprocate under a displacement action of a piston arranged slidably along said cylinder chambers;

a guide mechanism which guides said slider in said axial direction of said main cylinder body; and a displacement amount-adjusting mechanism which adjusts a displacement amount of said slider, wherein said slider is integrally formed by metal injection molding or casting, said displacement amount-adjusting mechanism includes a stopper which faces a cutout formed between said main cylinder body and said slider and which is fixed to one of said main cylinder body and said slider, and a first adjuster bolt which is provided movably back and forth on the other of said main cylinder body and said slider, and said displacement amount-adjusting mechanism further includes an attachment member which is fixed to an end surface of said main cylinder body in said axial direction, and a second adjuster bolt which is installed movably back and forth to said attachment member, and said second adjuster bolt is capable of making abutment against an end surface of said slider.

2. The linear actuator according to claim 1, wherein said stopper is fixed to said main cylinder body by being screwed into a screw hole formed on an upper surface of said main cylinder body, and said first adjuster bolt is screwed into a screw hole formed at an end of said slider and fixed by a lock nut.

3. The linear actuator according to claim 1, wherein a through-hole, which communicates with said cutout, is provided at an upper surface of said slider.

4. The linear actuator according to claim 1, wherein a sensor attachment rail is detachably provided on one side surface disposed in parallel to an axis of said main cylinder body.

5. The linear actuator according to claim 4, wherein a piping block is connected to the other side surface disposed in parallel to said axis of said main cylinder body.

6. The linear actuator according to claim 5, wherein said piping block is provided with piping members which makes it possible to extract a piping in said axial direction of said main cylinder body.

7. A linear actuator comprising:

a main cylinder body which is formed with cylinder chambers communicating with fluid inlet/outlet ports;

a slider which reciprocates in an axial direction of said main cylinder body;

a cylinder mechanism which allows said slider to reciprocate under a displacement action of a piston arranged slidably along said cylinder chambers; and a guide mechanism which guides said slider in said axial direction of said main cylinder body, wherein a piston rod, which is exposed outside of said main cylinder body, is connected to said piston, a first bush and a second bush, which have floating functions, are provided at a connecting portion between said piston rod and said slider, and seal rings are respectively installed to contact surfaces of said first bush and said second bush which make contact with said slider.

8. The linear actuator according to claim 7, wherein said main cylinder body is provided with suction ports.

9. The linear actuator according to claim 8, wherein a rod cover, which supports said piston rod displaceably, is installed in said main cylinder body, and said rod cover is formed with a plurality of holes which communicate with said suction ports.

* * * * *